US007706715B2

(12) United States Patent
Mori et al.

(10) Patent No.: US 7,706,715 B2
(45) Date of Patent: Apr. 27, 2010

(54) IMAGE FORMING APPARATUS AND DEVELOPER CARTRIDGE

(75) Inventors: Hiroki Mori, Nagoya (JP); Mitsuru Horinoe, Aichi-ken (JP); Yukiko Nakaya, Kounan (JP); Yuichi Matsushita, Nagoya (JP); Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 169 days.

(21) Appl. No.: 11/689,790

(22) Filed: Mar. 22, 2007

(65) Prior Publication Data

US 2007/0223958 A1 Sep. 27, 2007

(30) Foreign Application Priority Data

Mar. 27, 2006 (JP) ..... 2006-084498

(51) Int. Cl.
*G03G 15/08* (2006.01)

(52) U.S. Cl. ..... 399/103; 399/105

(58) Field of Classification Search ..... 399/103, 399/105

See application file for complete search history.

(56) References Cited

U.S. PATENT DOCUMENTS 6,356,723 B1 3/2002 Sato et al.
6,405,003 B2 6/2002 Uehara
6,496,669 B2 12/2002 Sato et al.

FOREIGN PATENT DOCUMENTS

| | | |
|---|---|---|
| CN | 1285532 | 2/2001 |
| CN | 1728010 | 2/2006 |
| JP | 2000147906 | 5/2000 |
| JP | 2001134080 | 5/2001 |
| JP | 2001289327 | 10/2001 |

OTHER PUBLICATIONS

Chinese First Office Action, Application No. 200710089691.7, Mailing Date Jul. 11, 2008.

*Primary Examiner*—David M Gray
*Assistant Examiner*—Andrew V Do
(74) *Attorney, Agent, or Firm*—Banner & Witcoff, Ltd.

(57) ABSTRACT

A developer cartridge includes a developer cartridge case for accommodating a developer, a developing roller, a toner layer thickness control blade, and a side sealing member. The developing roller is supported by the developer cartridge case such that a circumferential surface thereof is exposed to an outside of the developer cartridge case along a width direction. The toner layer thickness control blade includes a blade body portion made of a metallic plate. A tip portion of the blade body portion is disposed at a sliding portion of the developing roller and the side sealing member so as to contact with the side sealing member. A frictional heat generated at the sliding portion is released to the outside of the developer cartridge case through the blade body portion in order restrain a leak of the developer as much as possible.

8 Claims, 7 Drawing Sheets

IMAGE FORMING APPARATUS AND DEVELOPER CARTRIDGE

CROSS-REFERENCE TO RELATED APPLICATIONS

This Non-provisional application claims priority under 35 U.S.C. §119(a) on Patent Application No. 2006-84498 filed in Japan on Mar. 27, 2006, the entire contents of which are hereby incorporated by reference.

BACKGROUND OF THE INVENTION

1. Field of the Invention

The present invention relates to an image forming apparatus which is configured so as to arrange fine particles of a developer in an image-wise manner at an image-forming section to form an image by the developer onto a recording medium. Further, the present invention relates to a developer cartridge (or a developer supply cartridge) removably provided (or attached) in a body frame of the image forming apparatus, the cartridge being configured so as to accommodate the developer and to be capable of supplying the developer to the image-forming section at which the fine particles of the developer is to be arranged in an image-wise manner in the body frame.

2. Description of the Related Art

An image forming apparatus is widely known, which is configured so as to form an image by use of a developer which is composed of fine particles having charging characteristics. The image forming apparatus is configured, by charging the developer and arranging in an image-wise manner the charged developer with electrostatic action, so as to form the image by the developer onto a certain recording medium.

A development device is accommodated in the image forming apparatus. Within a case serving as a casing of the development device, a developer accommodation chamber is formed. Within the developer accommodation chamber, the developer of nonmagnetic-monocomponent having positive charging characteristics is accommodated.

There is provided a developing chamber which communicates with the developer accommodation chamber within the case. In the developing chamber, a developing roller is rotatably supported. The developing roller is configured so as to be capable of carrying the developer on its circumferential surface. Further, a layer thickness control blade is attached to the case. The layer thickness control blade is composed of a thin plate-like member having an elasticity and is capable of controlling an amount of the developer carried on the developing roller up to a predetermined amount.

In this image forming apparatus, there may arise a problem that the developer leaks from the development device (especially, from both end portions of the developing roller), and thus an image, which is being formed, is disarranged, for instance. In order to avoid the problem, a side sealing member is provided in the development device. The side sealing member is attached at both end portions of the case by use of a two-sided tape.

As a conventional art of this type, a development device and an image forming apparatus disclosed in Japanese Patent Application Laid-Open (kokai) No. 2001-134080 are known. A side sealing member disclosed in the patent application includes a sponge layer and a felt member.

The sponge layer is composed of urethane sponge having a predetermined thickness, sufficient flexibility, and less permanent deformation in compression. The felt member is a member which constitutes a top layer of the side sealing member. The felt member and the sponge layer are pasted together. The felt member is pressed against the developing roller by the sponge layer with a predetermined pressing force.

In the development device and the image forming apparatus having the configuration described above, the developing roller is rotated while the felt member frictionally slides on the circumferential surface at both end portions of the developing roller during the image forming operation. In this case, the sliding portion between the circumferential surface and the felt member restrains the leak of the developer to an outside of the development device.

However, in the conventional development device and image forming apparatus described in the above-mentioned Japanese Patent Application Laid-Open (kokai) No. 2001-134080, there is a possibility that the developer enters (intrudes) into the sliding portion during repetition of the image-forming operation. If the image-forming operation is continuously performed under this condition for a long time, temperature of the sliding portion may increase due to heat caused by the friction, and whereby the developer, which has been entered into the sliding portion, may melt.

The developer which has melted due to the high temperature of the sliding portion caused by the frictional heat may become solidified with caking (sticking) onto the felt member. This may cause deterioration in a close contact condition in the sliding portion between the circumferential surface at the both end portions of the developing roller and the felt member. This deterioration in the close contact condition may cause the developer to leak from the sliding portion. That is, the developer may leak from the both end portions of the developing roller in the development device.

SUMMARY OF THE INVENTION

The present invention has been accomplished to solve the above problems. It is an object of the present invention to provide an image forming apparatus in which the leak of the developer is restrained as much as possible. Another object of the present invention is to provide a developer cartridge, which is configured so as to be capable of supplying the developer to a predetermined image-forming section in the image forming apparatus and to be capable of restraining the leak of the developer as much as possible.

(1) An image forming apparatus to which the present invention is applied is configured so as to arrange fine particles of a developer in an image-wise manner at an image-forming section to form an image by the developer onto a recording medium. This image forming apparatus comprises a body frame, a developer-supply section, and a recording-medium-transport mechanism.

The recording-medium-transport mechanism is configured so as to transport the recording medium along a predetermined transport path, while attaching the developer onto the recording medium. The developer-supply section is accommodated within the body frame. This developer-supply section is configured so as to be capable of accommodating the developer and supplying the accommodated developer to the image forming section.

Specifically, the developer-supply section comprises a developer-carrying member, a developer-accommodation section, and a sealing member. The developer-carrying member is formed to have a substantially cylindrical shape having a central axis in a direction perpendicular to a transport direction of the recording medium by means of the recording-medium-transport mechanism. The developer-accommodation section is configured so as to be capable of accommodating the developer-carrying member and the developer. At the developer-accommodation section, there is provided an opening section which enables a part of a circumferential surface of the developer-carrying member to be exposed therefrom along the central axis of the developer-carrying member. The sealing member is provided so as to be interposed between an end portion in the direction of the central axis of the developer-carrying member and the developer-accommodation section. The sealing member is configured in such a manner that it slides on the circumferential surface of the developer-carrying member, and thereby it can restrain a leak of the developer from (or through) the opening section to an outside of the developer-accommodation section.

(1-1) The present invention is characterized in that the developer-supply section further comprises a heat-release member. Here, the heat-release member is composed of a member having good heat conductance. Further, the heat-release member is provided so as to extend toward an outside from a sliding portion of the circumferential surface of the developer-carrying member and the sealing member. The heat-release member is configured so as to be capable of releasing a frictional heat which is generated at the sealing member of the sliding portion.

In the image forming apparatus thus configured of the present invention, the circumferential surface of the developer-carrying member frictionally slides on the sealing member at the sliding portion, during an image-forming operation. This frictional slide generates frictional heat at the sliding portion. Meanwhile, as described above, the heat-release member has good heat conductance and is provided so as to extend from the sliding portion toward outside. Accordingly, the frictional heat generated at the sliding portion is released through the heat-release member to the outside of the sliding portion.

According to this configuration, the rise in temperature at the sliding portion is restrained during the image-forming operation. Therefore, it can be restrained for the developer, which has entered (intruded) into the sliding portion, to be melted and be caked (stuck) onto the sealing member. Accordingly, a deterioration in a close contact condition can be restrained between the circumferential surface of the developer-carrying member and the sealing member in the sliding portion. As a result, the leak of the developer at the sliding portion can be restrained as much as possible.

(1-2) The developer-supply section may be configured as described below. The developer-supply section further comprises a developer-carrying-amount control member. The developer-carrying-amount control member includes a control-member body section and a developer-carrying-amount control section. The control-member body section serving as the heat-release member is composed of a metallic plate. The developer-carrying-amount control section is provided at a tip portion of the control-member body section. The developer-carrying-amount control section is configured so as to be capable of adjusting (or controlling) a carrying amount of the developer on the circumferential surface of the developer-carrying member, by contacting with the circumferential surface. The developer-carrying-amount control member is fixed to the developer-accommodation section in such a manner that the sealing member contacts with the control-member body section.

In the image forming apparatus having the configuration described above, during the image-forming operation, the developer-carrying-amount control section, which is provided at the tip portion of the control-member body section in the developer-carrying-amount control member, contacts with the circumferential surface of the developer-carrying member. Accordingly, the carrying amount of the developer on the circumferential surface is adjusted. Further, the control-member body section contacts with the sealing member. Accordingly, the frictional heat generated at the sliding portion is released to the outside through the control-member body section in the developer-carrying-amount control member.

According to this image forming apparatus, the restraint of the rise in temperature at the sliding portion during the image-forming operation is realized with an extremely simplified apparatus configuration. Accordingly, the leak of the developer at the sliding portion can effectively be restrained with the extremely simplified apparatus configuration.

(1-3) The developer-supply section may be configured as described below. The sealing member comprises a sliding member and a sealing body. The sliding member is a sheet-like member having a surface of low coefficient of friction. The sliding member is disposed so as to contact with the circumferential surface at the end portion of the developer-carrying member. The sealing body is attached to the sliding member and the developer-accommodation section. The sealing body is composed of a foamable synthetic resin having an elasticity so as to be able to bias the sliding member toward the circumferential surface of the developer-carrying member. The developer-carrying-amount control member is disposed (or arranged) in such a manner that the control-member body section contacts with the sliding member.

In the image forming apparatus having the configuration described above, the sliding member is elastically biased toward the circumferential surface of the developer-carrying member by means of the sealing body. Accordingly, at the sliding portion, the circumferential surface contacts with the sliding member closely. Meanwhile, as described above, the frictional heat at the sliding portion can be released to outside by means of the heat-release member. Therefore, melting of the developer due to the rise in temperature of the sliding member caused by the frictional heat and being caked of the melted developer onto the sealing member can be restrained.

According to this configuration, it is possible to maintain the favorable close contact between the circumferential surface of the developer-carrying member and the sealing member at the sliding portion. Therefore, it is possible to more effectively restrain the leak of the developer at the sliding portion.

(1-4) The developer-supply section may further comprise an auxiliary sealing member which is provided so as to be interposed between the control-member body section and the developer-carrying member.

In the image forming apparatus having the configuration described above, the auxiliary sealing member is disposed at a clearance between the control-member body section in the developer-carrying-amount control member and the developer-carrying member. Therefore, with this configuration, it is possible to restrain the leak of the developer from the clearance as much as possible.

(1-5) The developer-supply section may be configured as described below. The sealing member comprises a sliding member, a metallic sheet for heat-release, and a sealing body. The sliding member is a sheet-like member having a surface of low coefficient of friction. The sliding member is disposed (or arranged) so as to contact with the circumferential surface at the end portion of the developer-carrying member. The metallic sheet serving as the heat-release member is composed of a thin metallic plate which is set to be attached to the sliding member. The sealing body is attached to the metallic sheet and the developer-accommodation section. This sealing body is composed of a foamable synthetic resin having an elasticity so as to be able to bias the sliding member toward the circumferential surface of the developer-carrying member.

In the image forming apparatus having the configuration described above, during the image-forming operation, the circumferential surface of the developer-carrying member frictionally slides on the sliding member. This frictional slide generates frictional heat at the sliding member. Meanwhile, as described above, the sliding member is set to be attached to the metallic sheet. Accordingly, the frictional heat, which has been generated at the sliding member, is released to the outside from the sliding portion of the sliding member and the circumferential surface of the developer-carrying member through the metallic sheet. Further, the sliding member is elastically biased by the sealing body toward the circumferential surface of the developer-carrying member. Accordingly, the sliding member closely contacts with the circumferential surface favorably.

By means of this configuration, the rise in temperature of the sliding member is restrained during the image-forming operation. Accordingly, it can be restrained for the developer, which has entered (intruded) into the clearance between the sliding member and the circumferential surface of the developer-carrying member, to be melted and be caked (or stuck) onto the sealing member. Therefore, a deterioration in a close contact condition can be restrained between the circumferential surface of the developer-carrying member and the sealing member. Further, the sealing body elastically biases the sliding member to the circumferential surface of the developer-carrying member, and thereby the close contact condition between the circumferential surface and the sliding member is improved. Accordingly, the leak of the developer from the clearance between the sliding member and the circumferential surface of the developer-carrying member can be restrained as much as possible.

(1-6) The sealing member may be configured in such a manner that the metallic sheet is exposed toward space outside of the developer-accommodation section at outside of the opening section.

In the image forming apparatus having the configuration described above, the frictional heat generated at the sliding member during the image-forming operation is transmitted to the metallic sheet. The heat, which has been transmitted to the metallic sheet, can be released from a position, in the metallic sheet for heat-release, exposed to the space outside of the developer-accommodation section toward the same space. That is, the metallic sheet can be cooled by heat radiation to the space.

According to this configuration, the rise in temperature of the sliding member during the image-forming operation is effectively restrained by means of the extremely simplified apparatus configuration. Therefore, the leak of the developer from the clearance between the sliding member and circumferential surface of the developer-carrying member can effectively be restrained with the extremely simplified apparatus configuration.

(2) A developer cartridge of the present invention is configured so as to be removably (or detachably) attached to the body frame. This developer cartridge is configured so as to accommodate a developer and to be capable of supplying the developer to an image-forming section at which the developer is to be arranged in an image-wise manner in a body frame of an image forming apparatus. The present invention is characterized in that the developer cartridge comprises the developer-carrying member, the developer-accommodation section, the sealing member, and the heat-release member.

According to this configuration, the leak of the developer from the developer cartridge during the image-forming operation can be favorably restrained.

BRIEF DESCRIPTION OF THE DRAWINGS

The above and other objects, features and advantages of the present invention will be apparent from the following detailed description of the preferred embodiments of the invention in conjunction with the accompanying drawings, in which.

DESCRIPTION OF THE PREFERRED EMBODIMENT

An embodiment of the present invention (an embodiment which the applicant(s) of the present invention believe(s) is the best at the time of filing of the present patent application) will next be described with reference to the drawings.

Figure 1:
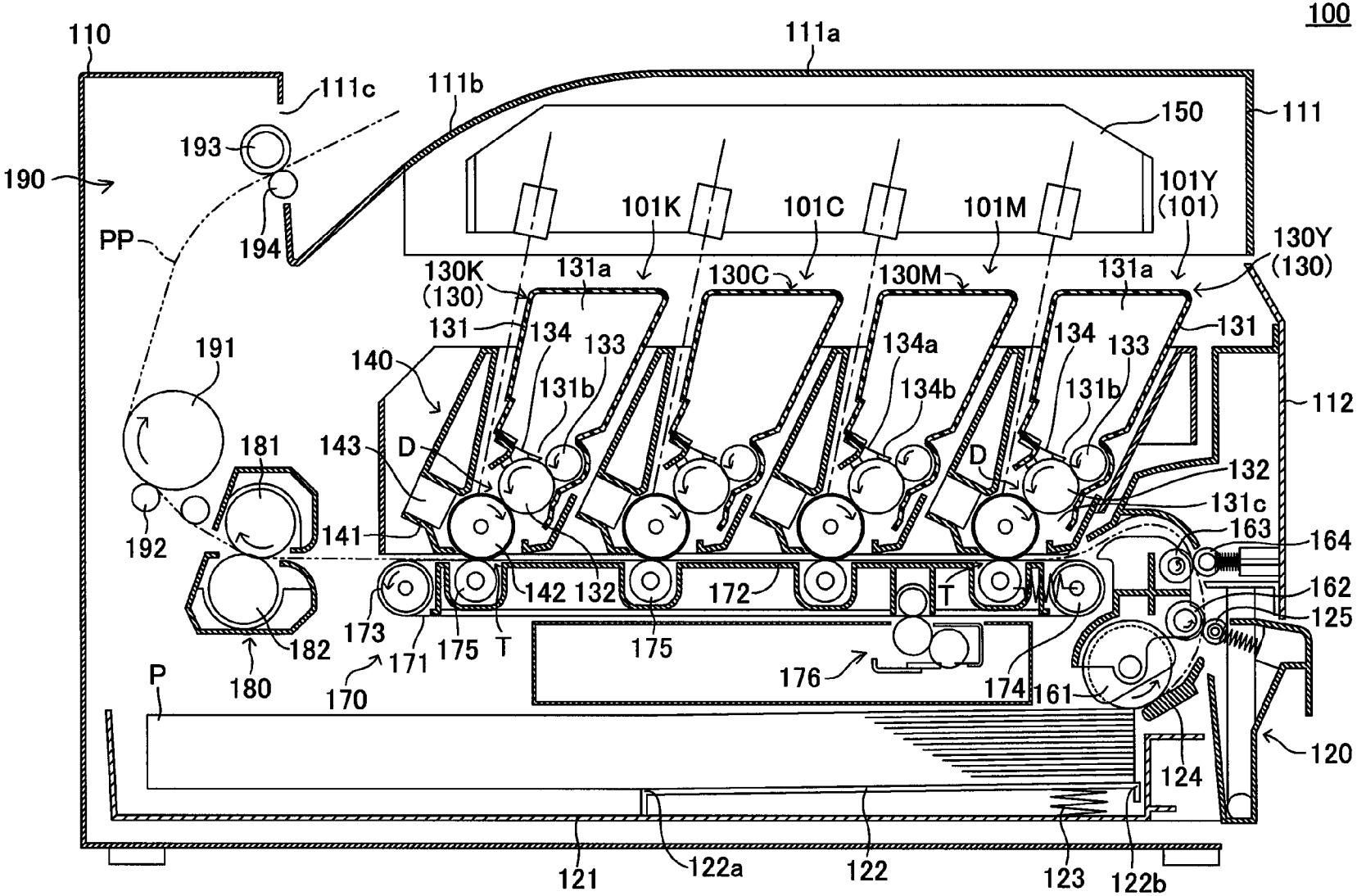
FIG. 1 is a cross-sectional side view of a color laser printer, which is an embodiment of an image forming apparatus of the present invention.

Overall Configuration of Color Laser Printer:

FIG. 1 is a cross-sectional side view of a color laser printer 100, which is an embodiment of an image forming apparatus according to the present invention. In the following description, a right side in FIG. 1 is called a "front" side of the color laser printer 100. A left side in FIG. 1 is called a "rear" side of the color laser printer 100. A vertical direction in FIG. 1 is called a "height direction" of the color laser printer 100. A horizontal direction in FIG. 1 is called a "front-and-rear direction" of the color laser printer 100. Further, a direction perpendicular to a sheet on which FIG. 1 is drawn, is called a "width direction."

The color laser printer 100 of the present embodiment is configured in such a manner that it can form a polychromatic image on a paper P, serving as a sheet-like recording medium, while transporting the paper P along a predetermined paper path PP, as described below.

The color laser printer 100 includes four image-forming units 101. That is, a yellow image-forming unit 101Y, a magenta image-forming unit 101M, a cyan image-forming unit 101C, and a black image-forming unit 101K are accommodated in a body casing 110 which constitute a body frame of the color laser printer 100. The yellow image-forming unit 101Y, the magenta image-forming unit 101M, the cyan image-forming unit 101C, and the black image-forming unit 101K are, in this order, arranged in the front-and-rear direction from the front side to the rear side.

The body casing 110 includes an upper cover 111 and a front cover 112.

A catch tray (or a paper-ejection tray) 111*b* is formed at a portion in the rear side on an upper surface 111*a* of the upper cover 111. The catch tray 111*b* is formed by an inclined plane which extends obliquely downward from the front side to the rear side. A paper-ejection port 111*c* is formed above a lower end portion (an end portion in the rear side) of the catch tray 111*b*. That is, the catch tray 111*b* is configured in such a manner that sheets of paper P, on which an image has formed, which are ejected from the paper-ejection port 111*c* are piled (or held) thereon.

The front cover 112 is configured so as to turn (or rotate) around a lower portion thereof along the front-and-rear direction, and thereby to be capable of opening and closing the front side of the body casing 110. The front cover 112 is configured in such a manner that, when the yellow image-forming unit 101Y, the magenta image-forming unit 101M, the cyan image-forming unit 101C, and the black image-forming unit 101K are mounted (installed) to or removed from the body casing 110, it turns in a clockwise direction in FIG. 1 to thereby allow the front side of the body casing 110 to be opened.

Paper-Feed Cassette:

In a bottom portion of the body casing 110, a paper-feed cassette (or a paper feed unit) 120 is detachably provided. The paper-feed cassette 120 is configured so as to be capable of accumulating the paper P in a layered manner.

The paper-feed cassette 120 includes a cassette case 121. The cassette case 121 is a box-like member constituting a casing of the paper-feed cassette 120, and is configured such that its upper portion is opened upwardly. Inside the cassette case 121, a paper-pressing plate 122, on which paper sheets are placed, is disposed. The paper-pressing plate 122 is configured so as to be able to pivot on a pressing plate-rear end portion 122*a* which is an end portion in the rear side, while a pressing plate-front end portion 122*b* which is an end portion in the front side moving along the height direction as a free end. A pressing plate-biasing spring 123 is arranged under the pressing plate-front end portion 122*b* so as to be able to bias the pressing plate-front end portion 122*b* upwardly.

A separation pad 124 is disposed at a position adjacent to an end portion in the front side of the cassette case 121 and downstream of the pressing plate-front end portion 122*b* in a paper-transport direction. An upper surface of the separation pad 124 is composed of a material, such as a rubber, whose coefficient of friction is greater than coefficient of friction of the paper. The separation pad 124 is biased upwardly from underneath of the pad 124 by means of an unillustrated spring.

A pinch roller 125 is disposed at an upper end portion of the cassette case 121 in the front side, which is downstream of the separation pad 124 in the paper-transport direction. The pinch roller 125 is rotatably supported by the cassette case 121.

Overall Configuration of Developer Cartridge:

A plurality of developer cartridges 130 (a yellow developer cartridge 130Y, a magenta developer cartridge 130M, a cyan developer cartridge 130C, and a black developer cartridge 130K) serving as a developer-supply section of the present invention are disposed above the paper-feed cassette 120 and inside the body casing 110. The developer cartridges 130 constitute the foregoing image-forming unit 101.

The yellow developer cartridge 130Y, the magenta developer cartridge 130M, the cyan developer cartridge 130C, and the black developer cartridge 130K are disposed in this order from the front side to the rear side of the color laser printer 100. Toners (developers) composed of fine particles having a color of yellow, magenta, cyan, and black, are accommodated in the yellow developer cartridge 130Y, the magenta developer cartridge 130M, the cyan developer cartridge 130C, and the black developer cartridge 130K, respectively.

Referring to inside the yellow developer cartridge 130Y shown in FIG. 1, a developer cartridge case 131, which constitute a casing of the developer cartridge 130, is a box-like member composed of synthetic resin plates. The developer cartridge case 131, which constitutes a developer-accommodation section of the present invention, is configured so as to accommodate the toner. Specifically, the developer cartridge case 131 includes a toner tank 131*a* and a roller-support section 131*b*.

The above-mentioned toner is accommodated in a space inside the toner tank 131*a*. The roller-support section 131*b* is provided in such a manner that it communicates with the toner tank 131*a*. The roller-support section 131*b* is configured so as to accommodate a developing roller 132 and a supply roller 133, both of which will be described later.

A developing roller-exposure opening 131*c* as an opening section of the present invention is formed at an end portion of the roller-support section 131*b*, the end portion being in one side opposite to the other side of the roller-support section 131*b* closer to the toner tank 131*a*. The developing roller-exposure opening 131*c* is provided so as to extend over a substantially entire area of the developer cartridge case 131 in the width direction The above-mentioned developing roller 132, which constitutes a developer-carrying member of the present invention, is rotatably supported by the roller-support section 131*b*. The developing roller 132 is a substantially cylinder-shaped member having a central axis which is parallel to the width direction perpendicular to the paper-transport direction. Specifically, the developing roller 132 is comprised of a metallic rotating center shaft and a semi-electrically conductive synthetic rubber-layer formed around (or surrounding) the rotating center shaft.

Figure 2:
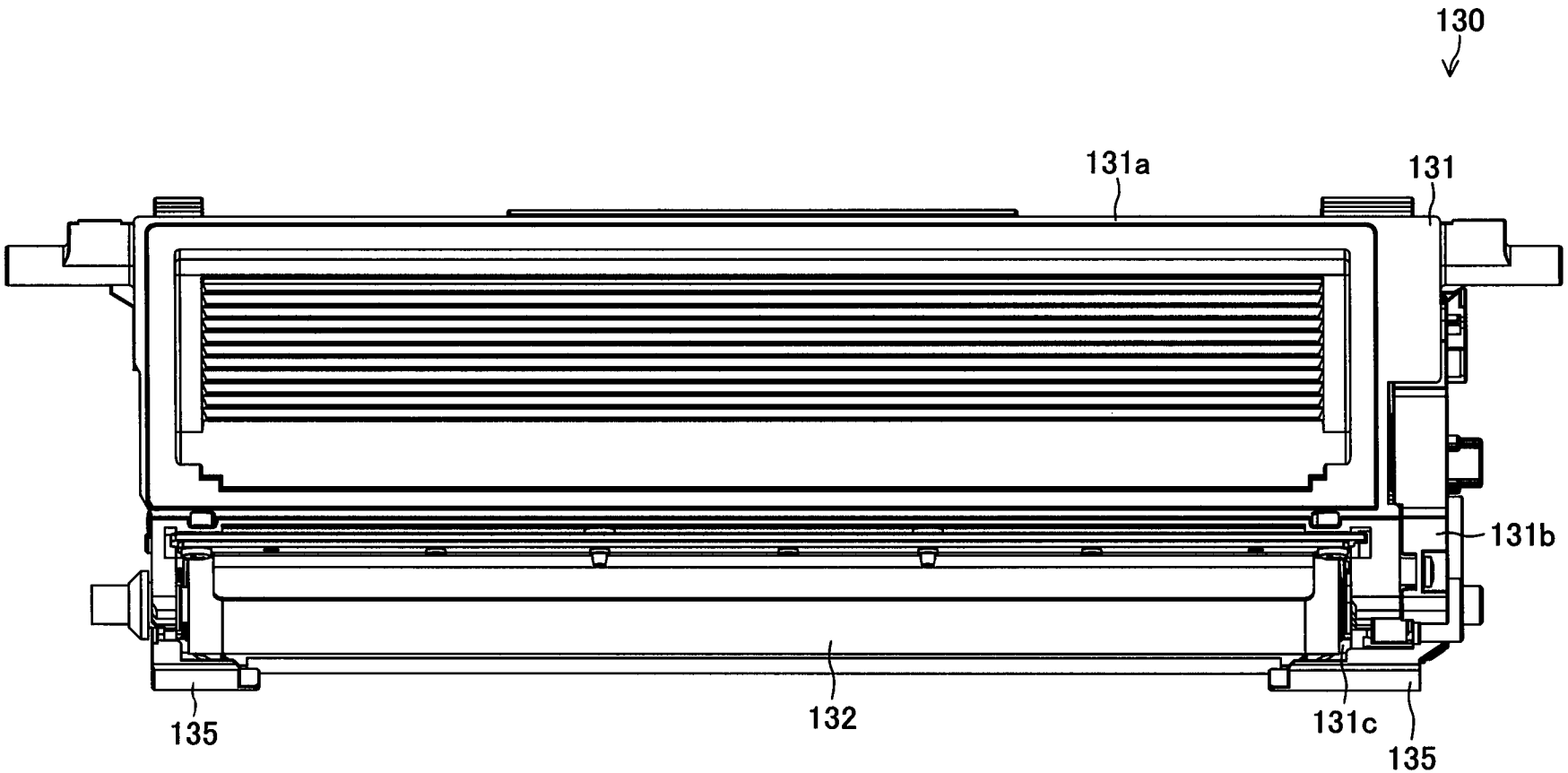
FIG. 2 is an external view of a developer cartridge shown in FIG. 1, as viewed from a rear side of the developer cartridge.
Figure 3:
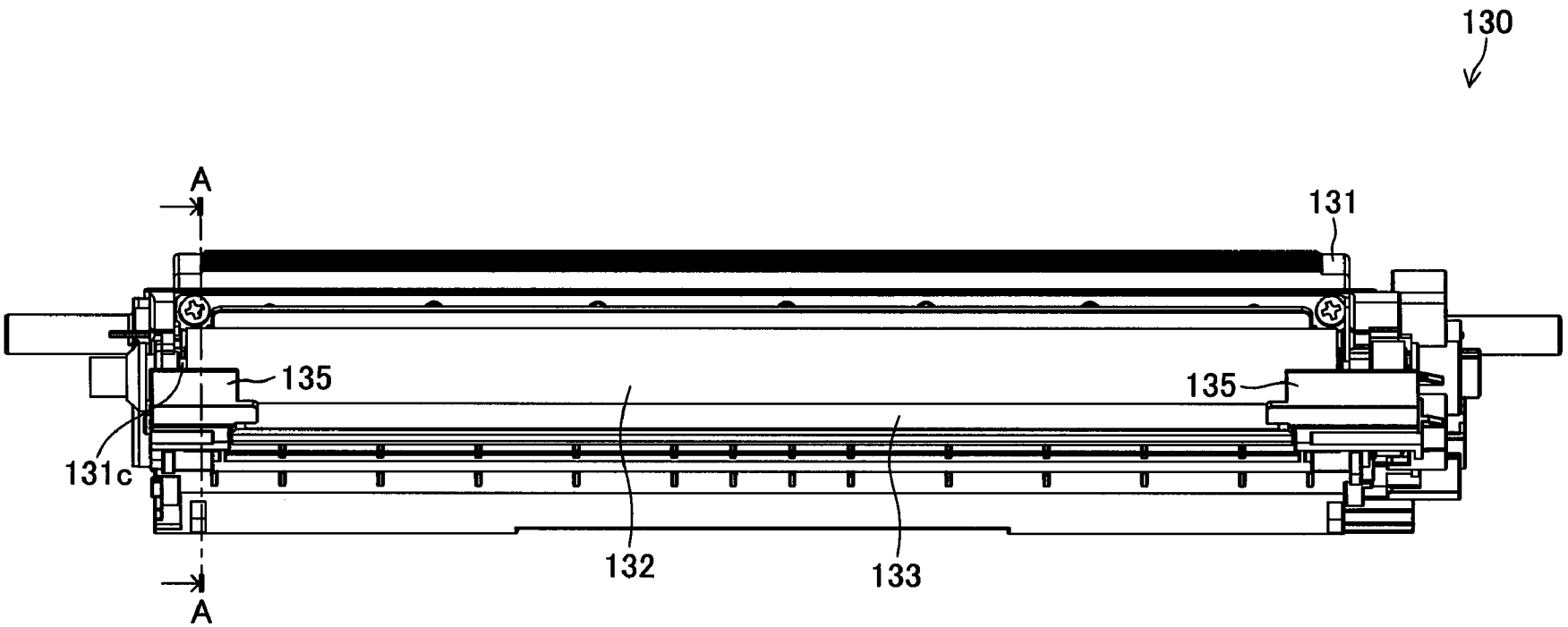
FIG. 3 is an external view of the developer cartridge shown in FIG. 1, as viewed from an obliquely downward side (from a side of the developing roller-exposure opening)

FIG. 2 is an external view of the developer cartridge 130 shown in FIG. 1, as viewed from the rear side of the developer cartridge 130. FIG. 3 is an external view of the developer cartridge 130 shown in FIG. 1, as viewed from an obliquely downward side (from a side of the developing roller-exposure opening 131*c*).

Referring to FIGS. 2 and 3, the developing roller 132 is disposed in such a manner that its circumferential surface is exposed toward outside of the developing roller-exposure opening 131*c* along the central axis direction, that is, the width direction. In the present embodiment, an entirety of the circumferential surface of the developing roller 132 in the width direction is exposed to outside from (or through) the developing roller-exposure opening 131*c*. Further, a substantially half of the circumferential surface of the developing roller 132 in a rotation direction (a circumferential direction in the cylinder-shape) is exposed to outside from (or through) the developing roller-exposure opening 131*c*.

Referring back to FIG. 1, the above-mentioned supply roller 133 is rotatably supported by the roller-support section 131*b*. The supply roller 133 is comprised of a metallic rotating center shaft and a sponge layer formed around (or surrounding) the rotating center shaft. The supply roller 133 is disposed in parallel to the developing roller 132 so as to contact with the developing roller 132 with a predetermined pressing force at a position inside of the developer cartridge case 131 with reference to the developing roller 132 (in a side closer to the toner tank 131*a* than the developing roller 132).

The developing roller 132 and the supply roller 133 are configured, by being rotated in a direction indicated by an arrow in FIG. 1, so as to charge the toner at a contact portion of the two and to be capable of carrying the charged toner on the circumferential surface of the developing roller 132.

A toner layer thickness control blade 134, which serves as a developer-carrying-amount control member of the present invention, is fixed onto the roller-support section 131*b*. The toner layer thickness control blade 134 includes a blade body section 134*a*, which constitutes a control-member body section and a heat-release member of the present invention, and a rubber tip 134*b*, which constitutes a developer-carrying-amount control section of the present invention (see inside of the magenta developer cartridge 130M in FIG. 1).

The blade body section 134*a* is composed of a thin metallic plate having good heat conductance. The blade body section 134*a* is formed in a substantially rectangular shape having a longitudinal direction in the above-mentioned width direction. The rubber tip 134*b* is composed of a thin and long beam-like (or a long scale-like) plate made of a synthetic rubber having a longitudinal direction in the above-described width direction. The rubber tip 134*b* is fixed at a tip portion of the blade body section 134*a*.

In the present embodiment, as described later, a width (a dimension in the longitudinal direction) of the rubber tip 134*b* is designed to be somewhat narrower (or shorter) than a width of the blade body section 134*a*. That is, the toner layer thickness control blade 134 is configured in such a manner that a portion, where the rubber tip 134*b* is not provided, is formed at both end portions in the width direction of the tip of the blade body section 134*a* in a state where the rubber tip 134*b* is fixed at the tip of the blade body section 134*a*.

The toner layer thickness control blade 134 is fixed at the roller-support section 131*b* in such a manner that a portion of the circumferential surface of the developing roller 132, the portion being adjacent to the contact section of the developing roller 132 and the supply roller 133 and downstream of the contact section in the rotational direction of the developing roller 132, is capable of elastically contacting with the rubber tip 134*b* by means of a flexure of the blade body section 134*a* with a predetermined pressing force. The toner layer thickness control blade 134 is configured in such a manner that the rubber tip 134*b* and the circumferential surface of the developing roller 132 which is being rotated in the direction shown by the arrow in FIG. 1 contact with each other in a counter direction so as to control (or adjust) an amount of and a charge amount of the toner carried on the circumferential surface.

Referring back to FIGS. 2 and 3, a pair of side guard members 135 is mounted onto the developer cartridge case 131. The side guard members 135 are provided so as to correspond to both end portions of the developer cartridge case 131 in the width direction of the developing roller-exposure opening 131*c*. These side guard members 135 are configured in such a manner that, in the event that the toner leaks from a clearance between both end portions in the width direction of the developer cartridge case 131 and the developing roller 132, they can receive the leaked toner.

Configurations to restrain leak of toner from a clearance between both end portions in the width direction of the developing roller 132 and the developing roller-exposure opening 131*c* will be described later in detail. The configurations constitute a substantial part of the developer cartridge 130 (especially, the developer cartridge case 131).

Drum Unit:

Referring back to FIG. 1, four of drum units 140, which constitute the above-mentioned image-forming unit 101, are disposed along the front-and-rear direction, in such a manner that each of the drum units 140 is opposed to the developing roller 132 in each of the developer cartridges 130. Each of the drum units 140 includes a drum unit case 141, a photoconductor drum 142, and a scorotron-type charger 143.

The drum unit case 141 is a frame-like member composed of a synthetic resin plate. The drum unit case 141 is configured so as to be capable of removably holding the above-mentioned developer cartridge 130.

The photoconductor drum 142 is rotatably supported by the drum unit case 141. The photoconductor drum 142 is configured in such a manner that an electrostatic latent image can be formed on its circumferential surface. The photoconductor drum 142 is placed so as to be opposed to the developing roller 132 in the developer cartridge 130 at an image-forming section D.

The scorotron-type charger 143 is fixed to the drum unit case 141. The scorotron-type charger 143 is disposed so as to be opposed to a part of the circumferential surface of the photoconductor drum 142, the part of the circumferential surface of the photoconductor drum 142 being upstream of a position where the developing roller 132 is opposed to the photoconductor drum 142 in a rotational direction (in a direction shown by an arrow in FIG. 1) of the photoconductor drum 142. The scorotron-type charger 143 is configured so as to be capable of uniformly (or evenly) charging the circumferential surface of the photoconductor drum 142.

Scanner Unit:

A scanner unit 150 is configured so as to be capable of scanning a laser beam (shown by alternate long and short dash line in FIG. 1), which is generated/modulated based on an image data at an unillustrated laser-emission section, in the width direction on the circumferential surface of the photoconductor drum 142 which has been uniformly charged by the scorotron-type charger 143. That is, the scanner unit 150 is configured so as to be capable of forming the electrostatic latent image on the circumferential surface of the photoconductor drum 142 by scanning the laser beam.

Paper-Feed Section:

A paper-feed section 160 is provided inside the body casing 110. The paper-feed section 160 is configured so as to be capable of feeding the paper P toward the developer cartridge 130 and the drum unit 140. The paper-feed section 160 includes a pick-up roller 161, a paper-feed roller 162, a resist-drive roller 163, a resist-opposite roller 164, and a paper-guide 165.

The pick-up roller 161 is rotatably supported within the body casing 110. The pick-up roller 161 is configured so as to be rotated in a direction shown by an arrow in FIG. 1 through an unillustrated driving force transmission mechanism provided within the body casing 110. Further, the pick-up roller 161 is disposed so as to contact with the paper P, which is biased upwardly by means of the pressing plate-front end portion 122*b* in the paper-feed plate 122 and the pressing plate-biasing spring 123, with a predetermined pressing force, when forming an image. Furthermore, the pick-up roller 161 is disposed so as to be opposed to the separation pad 124.

The paper-feed roller 162 is disposed at a position to which a paper is transported along the paper path PP from the pick-up roller 161. The paper-feed roller 162 is disposed so as to be opposed to the pinch roller 125. The paper-feed roller 162 is rotatably supported within the body casing 110. Further, the paper-feed roller 162 is configured so as to be rotated in a direction shown by an arrow in FIG. 1 through the driving force-transmission mechanism provided within the body casing 110.

The resist-drive roller 163 is disposed at a position above the paper-feed roller 162 to which the paper is transported along the paper path PP. The resist-drive roller 163 is rotatably supported within the body casing 110. The resist-drive roller 163 is configured so as to be rotated in a direction shown by an arrow in FIG. 1 through the driving force-transmission mechanism provided within the body casing 110.

The resist-opposite roller 164 is disposed at a position above the pinch roller 125 to which the paper is transported along the paper path PP. The resist-opposite roller 164 is disposed so as to be opposed to the resist-drive roller 163. The resist-opposite roller 164 is rotatably supported by the front cover 112.

Transfer Section:

Within the body casing 110, a transfer section 170, which serves as a recording-medium-transport mechanism of the present invention, is provided under the image-forming unit 101. The transfer section 170 comprises a paper-transport belt 171, a transfer frame 172, a belt-drive roller 173, a belt-support roller 174, and a belt cleaner 176.

The paper-feed transport belt 171 is composed of a film made of an electrically conductive plastic which is formed by dispersing electrically conductive particles such as carbon and the like into a resin made of polycarbonate, polyimide and the like. The paper-transport belt 171 is formed to be an endless belt.

The transfer frame 172 is a frame-like member composed of a synthetic resin plate. The belt-drive roller 173 is rotatably supported at an end portion in the rear side of the transfer frame 172. The belt-drive roller 173 is disposed at a more rear side than the photoconductor drum 142 opposite to the black developer cartridge 130K which is placed at the most rear side among the plurality of developer cartridges 130. The belt-drive roller 173 is configured so as to be rotated in a direction shown by an arrow in FIG. 1 through the driving force-transmission mechanism provided within the body casing 110.

The belt-support roller 174 is rotatably supported at an end portion in the front surface side of the transfer fame 172. The belt-support roller 174 is disposed at a more front side than the photoconductor drum 142 opposite to the yellow developer cartridge 130Y which is placed at the most front surface side among the plurality of developer cartridges 130.

The above-mentioned paper-transport belt 171 is supported so as to be stretched between the belt-support roller 174 and the belt-drive roller 173 with a predetermined tension. That is, the paper-transport belt 171 is tensioned in such a manner that a paper-transport surface which is an outer surface thereof is opposed to the photoconductor drums 142 in a plurality of the drum units 140. The belt-support roller 174 is supported by the transfer frame 172 so as to be capable of rotating together with a revolving movement of the paper-transport belt 171, the revolving movement being caused by means of a rotation in a direction shown by an arrow in FIG. 1 of the belt-drive roller 173.

The transfer roller 175 is rotatably supported by the transfer frame 172. The transfer roller 175 is disposed so as to be opposed to each of a plurality of photoconductor drums 142 to nip the paper-transport belt 171 therebetween. Further, an output terminal of a high voltage power source is electrically connected to the transfer roller 175. That is, the transfer roller 175 is configured so as to be capable of applying a transfer bias voltage for transferring the toner on the circumferential surface of the photoconductor drum 142 onto the paper P on the paper-transfer belt 171 to a transfer position T where the transfer roller 175 is opposed to the photoconductor drum 142.

The belt cleaner 176 is disposed under a portion of the paper-transfer belt 171, the portion being stretched under each of the transfer rollers 175. The belt cleaner 176 is configured so as to be capable of cleaning an entire portion in its width direction of a paper-transfer surface of the paper-transfer belt 171 which has passed the image-forming section D.

Fixing Section:

A fixing section 180 is disposed at a position inside the body casing 110 and downstream of the transfer section 170 in the paper-transfer direction. The fixing section 180 is configured so as to be capable of fixing an image formed on the paper P with the toner onto the paper P. The fixing section 180 includes a heat roller 181 and a pressure roller 182.

The heat roller 181 includes a roller body composed of a thin-walled cylindrical member made of a metal whose surface has been exfoliated, and a halogen lamp accommodated inside the roller body. The heat roller 181 is configured so as to be rotated in a direction shown by an arrow in FIG. 1 through the driving force-transmission mechanism provided within the body casing 110. The pressure roller 182, which is a roller made of a silicon rubber, is disposed so as to be pressed against the heat roller 181 with a predetermined pressure. The pressure roller 182 is configured so as to be driven to rotate by means of rotation of the heat roller 181 in a state where the paper P is nipped between the pressure roller 182 and the heat roller 181, to thereby be capable of transporting the paper P toward a paper-ejection port 111*c* with fixing the image formed by the toner onto the paper P.

Paper-Ejection Section:

A paper-ejection section 190 is provided at the most rear side inside the body casing 110 and above the fixing section 180. The paper-ejection section 190 is configured so as to be capable of ejecting the paper P outside the body casing 110 which has passed through the fixing section 180.

The paper-ejection section 190 includes a fixed paper-transport roller 191, a pinch roller 192, a paper-ejection roller 193, and a paper-ejection follower roller 194.

The fixed paper-transport roller 191 and the pinch roller 192 are disposed at positions to which the paper P is transported by the heat roller 181 and the pressure roller 182. The fixed paper-transport roller 191 is rotatably supported so as to be capable of being rotated in a direction shown by an arrow in FIG. 1. The pinch roller 192 is disposed so as to be opposed to the fixed paper-transport roller 191. The pinch roller 192 is supported in such a manner that it can be rotated freely so as to follow the rotation of the fixed paper-transport roller 191 in the direction shown by the arrow in FIG. 1. The fixed paper-transport roller 191 and the pinch roller 192 are configured so as to be capable of transporting the fixed paper P toward the paper-ejection port 111*c* by means of the rotation of the fixed paper-transport roller 191 in the direction shown by the arrow in FIG. 1.

The paper-ejection roller 193 and the paper-ejection follower roller 194 are disposed adjacently to the paper-ejection port 111*c* so as to face the paper-ejection port 111*c*. The paper-ejection roller 193 is rotatably supported so as to be capable of being rotated in a direction shown by the arrow in FIG. 1. The paper-ejection follower roller 194 is disposed so as to be opposed to the paper-ejection roller 193. The paper-ejection follower roller 194 is rotatably supported so as to be rotated to follow the rotation of the paper-ejection roller 193 in the direction shown by the arrow in FIG. 1. The paper-ejection roller 193 and the paper-ejection follower roller 194 are configured so as to be capable of ejecting the fixed paper P from the paper-ejection port 111*c* to outside of the body casing 110 by means of the rotation of the paper-ejection roller 193 in the direction shown by the arrow in FIG. 1.

Summary of Overall Configuration of Color Laser Printer:

As is described above, the color laser printer 100 of the present embodiment is configured so as to scan the laser beam generated/modulated on the basis of the image data on the circumferential surface of the photoconductor drum 142 by means of the scanner unit 150, and thereby to be capable of forming the electrostatic latent image on the circumferential surface.

Further, the color laser printer 100 is configured so as to supply the toner charged by the developer cartridge 130 to the electrostatic latent image formed on the circumferential surface of the photoconductor drum 142 at the image-forming section D, to thereby be capable of attaching the toner onto the circumferential surface of the photoconductor drum 142 with a pattern corresponding to the electrostatic latent image. That is, the color laser printer 100 is configured so as to be capable of arranging the toner in an image-wise manner at the image-forming section D.

Further, the color laser printer 100 is configured so as to transfer onto the paper P the toner which is attached on the circumferential surface of the photoconductor drum 142, while transporting the paper P along the paper path PP by means of the transfer section 170, to thereby be capable of arranging the toner onto the paper P in the image-wise manner. In addition, the color laser printer 100 is configured so as to fix the toner attached on the paper P by heating/pressurizing it with the fixing section 180, to thereby be capable of forming the image formed by the toner on the paper P.

Figure 4:
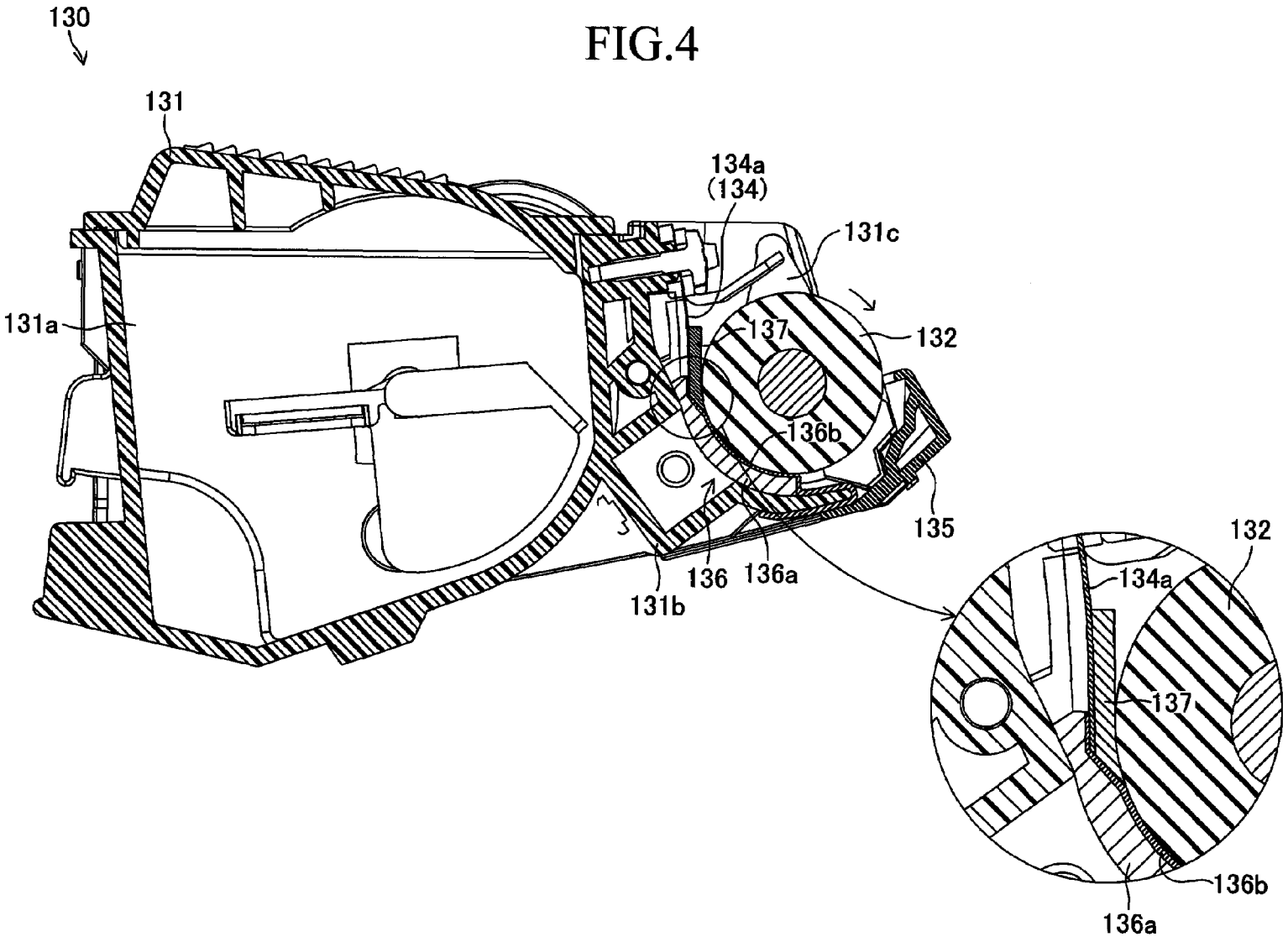
FIG. 4 is a cross-sectional view taken on line A-A in FIG. 3.
Figure 5:
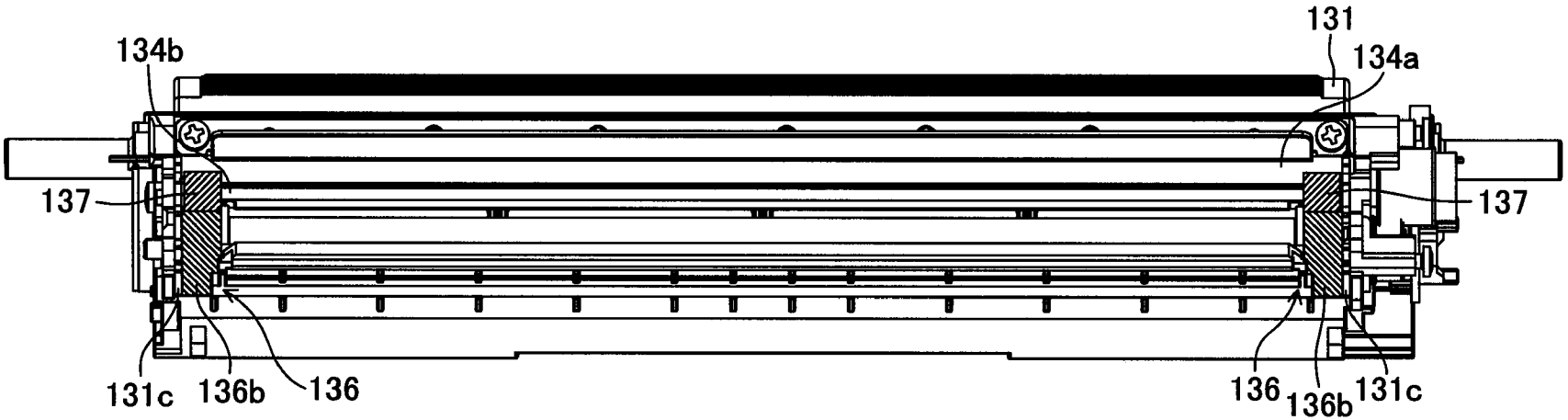
FIG. 5 is an external view of the developer cartridge case shown in FIG. 3, in a state where a developing roller and a side guard member are removed.

Detailed Structure of Substantial Part of Developer Cartridge:

FIG. 4 is a cross-sectional view taken on line A-A in FIG. 3 (it should be noted that an enlarged view covering the tip portion of the blade body section 134*a* (a portion which is encircled) is also shown in FIG. 4). FIG. 5 is an external view of the developer cartridge case 131 shown in FIG. 3, in a state where the developing roller 132 and the side guard member 135 are removed.

With reference to FIGS. 4 and 5, the details of the structures for restraining the leak of the toner from the clearance between the end portions in the width direction of the developing roller 132 and the developing roller-exposure opening 131*c* will now be explained.

A pair of side sealing members 136 is provided at both end portions in the width direction of the developer cartridge case 131 (developing roller-exposure opening 131*c*). Each of the side sealing members 136 is provided so as to be interposed between each of the both end portions in the width direction of the developing roller 132 and the developer cartridge case 131 (roller-support section 131*b*).

The side sealing member 136 is configured so as to slide over the circumferential surface of the developing roller 132, to thereby be capable of restraining the toner from leaking through (or from) the developing roller-exposure opening 131*c* to outside of the developer cartridge case 131. Specifically, the side sealing member 136 includes a side sealing body 136*a* which constitutes a sealing body of the present invention and a felt member 136*b* which constitutes a sliding member of the present invention.

The side sealing body 136*a* is composed of a foam sponge layer having a thickness of nearly 5 mm and an elasticity. The side sealing body 136*a* is fixed on the roller-support section 131*b* in the developer cartridge case 131 by use of a two-sided tape.

The felt member 136*b* is composed of a seat-like member having a surface of low coefficient of friction. Specifically, in the present embodiment, the felt member 136*b* is composed of a fluorine-series synthetic resin which has a thickness of nearly 0.5 to 1 mm and is in a raised state. The felt member 136*b* is disposed so as to cover a substantially entirety of a surface of the side sealing body 136*a* which is opposed to the developing roller 132. Further, the felt member 136*b* is provided so as to further extend toward a position upstream of an end portion of the side sealing member 136*a* in the rotational direction of the developing roller 132 (shown by an arrow in FIG. 4) and to turn around to reach a back side of the developer cartridge case 131.

The felt member 136*b* is attached and fixed to the side sealing body 136*a* by use of the two-sided tape. That is, the side sealing body 136*a* and the felt member 136*b* are layered each other by use of the two-sided tape. Each of the felt members 136*b* is disposed so as to contact with the circumferential surface at each of the both end portions in the width direction of the developing roller 132. Further, the felt member 136*b* is elastically biased toward the circumferential surface of the developing roller 132 by means of the side sealing body 136*a*.

Referring to FIG. 5, in the present embodiment, a width of the rubber tip 134*b* is designed to be some what narrower (or is set at a dimension which is smaller by a short length) than a width of the blade body section 134*a*. That is, the portions where the rubber tip 134*b* is not provided are formed at the both end portions in the width direction of the tip of the blade body section 134*a*. A blade side sealing member 137, which serves as an auxiliary sealing member, is attached and fixed to each of the portions where the rubber tip 134*b* is not provided.

Referring to FIG. 4, the blade side sealing member 137 is provided so as to be interposed in a clearance between the developing roller 132 and the blade body section 134*a*. The blade side sealing member 137 is composed of the foam sponge layer having a thickness of several millimeters. A tip portion (lower end portion in FIG. 4) of the blade side sealing member 137 is disposed so as to be capable of slightly contacting with the circumferential surface of the developing roller 132.

In the present embodiment, the toner layer thickness control blade 134 is disposed in such a manner that, portions of a surface of the blade body section 134*a* opposite to a surface to which the blade side sealing member 137 is attached and fixed, which are at the tip portion and the both end portions in the width direction, contacts with the felt member 136*b*. That is, the tip portion (lower end portion in FIG. 4) of the blade body section 134*a* is disposed so as to contact with the felt member 136*b* in the neighborhood of a sliding portion of the circumferential surface of the developing roller 132 and the felt member 136*b*. Further, the blade body section 134*a* is provided so as to extend toward outside (toward upper side in FIG. 4) from the sliding portion. The blade body section 134*a* is configured so as to be capable of releasing frictional heat generated at the felt member 136*b* of the sliding portion to outside.

In addition, in the present embodiment, the toner layer thickness control blade 134 is fixed to the developer cartridge case 131 (the roller-support section 131*b*) in such a manner that the side sealing member 136 elastically receives compression force by means of the tip portion of the blade body section 134*a*. That is, the blade body section 134*a* is disposed so as to get on an end portion of a laminated body of the side sealing body 136*a* and the felt member 136*b* (end portion at a downstream side in the rotational direction of the developing roller 132: upper end portion in FIG. 4) from above, and to thereby hold down the end portion of the laminated body. Explanation of operation of structure of the present embodiment:

The image-forming operation by means of the color laser printer 100 of the present embodiment will now be described with reference to FIG. 1.

Paper-Feed Operation:

When the pick-up roller 161 is driven to be rotated in the direction shown by the arrow in FIG. 1, the tip of the paper P which has been stacked within the cassette case 121 is fed to a position between the pick-up roller 161 and the separation pad 124. The pick-up roller 161 is driven to be rotated in the direction shown by the arrow in FIG. 1, and accordingly, only a paper P at a top of the stacked sheets of paper is fed to a position between the paper-feed roller 162 and the pinch roller 125.

The paper P, which has been fed toward the paper-transport direction by the paper-feed roller 162, is further fed to a position between the resist-drive roller 163 and the resist-opposite roller 164. After a skew correction and an adjustment of a paper-feed timing of the paper P are performed at the above-described position, the paper P is fed to the transfer position T between the yellow image-forming unit 101Y and the transfer section 170.

Developing Operation:

The toner within the developer cartridge case 131 is conveyed toward the developing roller 132 by means of the rotation in the direction shown by the arrow in FIG. 1 of the supply roller 133. Then, the toner is frictionally charged at the position where the developing roller 132 contacts with the supply roller 133, and is disengageably attached onto the circumferential surface of the developing roller 132. The circumferential surface of the developing roller 132 butts (or contacts) the rubber tip 134*b* of the toner layer thickness control blade 134 in the counter direction by means of the rotation in the direction shown by the arrow in FIG. 1. This counter-butt (or counter-direction-contact) allows the toner layer thickness control blade 134 to adjust a layer thickness and a charge amount of the toner which has been disengageably attached onto the circumferential surface of the developing roller 132 to a predetermined layer thickness and a predetermined charge amount, respectively. Thereafter, the toner is supplied to the image-forming section D where the developing roller 132 is opposed to the photoconductor drum 142 by the rotation in the direction shown by the arrow in FIG. 1 of the developing roller 132.

The circumferential surface of the photoconductor drum 142 is exposed to the laser beam (or receives a laser beam exposure) corresponding to an image information by means of the scanner unit 150, after having been uniformly (or evenly) charged by the scorotron-type charger 143. Accordingly, the electrostatic latent image, which corresponds to the image information, is formed on the circumferential surface of the photoconductor drum 142. At the image-forming section D, the circumferential surface of the photoconductor drum 142 on which the electrostatic latent image has been formed is made to be opposed to the circumferential surface of the developing roller 132 to which the toner having a predetermined density and the charge amount has been attached. Accordingly, the electrostatic latent image on the circumferential surface of the photoconductor drum 142 is developed by the toner. That is, the toner is disengageably attached onto the circumferential surface of the photoconductor drum 142 in the image-wise manner having an arrangement corresponding to the electrostatic latent image.

Transfer Operation:

The paper P, which has been fed to the transfer section 170, is transported from the front surface side to the rear side (from right to left in FIG. 1) by being supported on the paper-transport belt 171. When the paper P is transported to the transfer position T between the photoconductor drum 142 and the transfer roller 175, the toner on the circumferential surface of the photoconductor drum 142 is transferred onto the paper P by the transfer bias voltage between the transfer roller 175 and the photoconductor drum 142. That is, the toner is attached onto the surface of the paper P with the image-wise arrangement.

Fixing/Paper-Ejection Operation:

The paper having the toner attached to its surface through the transfer section 170 is transported to the fixing section 180. Then, the paper P is heated between the heat roller 181 and the pressurizing roller 182, while being nipped therebetween. Accordingly, the toner on the surface of the paper P is melted to be fixed to the surface. Therafeter, the paper P is ejected by the paper-ejection roller 193 toward the catch tray 111*b* which is outside of the body casing 110.

Operation/Effect by Means of Configuration of the Present Embodiment:

Next, operation/effect by means of the configuration of the present embodiment will be described with reference to FIGS. 4 and 5.

In the structure of the present embodiment, during the image-forming operation, the frictional heat is generated at the sliding portion of the circumferential surface of the developing roller 132 and the felt member 136*b* when the developing roller 132 is made to be rotated. This frictional heat is transmitted to the tip portion of the blade body section 134*a* which contacts with the felt member 136*b* in the neighborhood of the sliding portion. The heat, which has been transmitted to the tip portion of the blade body section 134*a*, is released to outside by means of (or thorough) the blade body section 134*a* which is the metallic plate provided so as to extend toward outside from the sliding portion. That is, the sliding portion is cooled by the blade body section 134*a* composed of the metallic plate.

According to this configuration, the rise in temperature at the sliding portion is more effectively restrained during the image-forming operation. Therefore, it can be restrained that the toner, which has entered into (or intruded inside) the sliding portion, is melted, and thereby to be caked (or stuck) onto the felt member 136*b*. Thus, a deterioration in the close contact condition of the circumferential surface of the developing roller 132 and the felt member 136*b* is restrained.

As is described above, according to the present embodiment, the leak of the developer at the sliding portion can be restrained as much as possible by means of a very simplified apparatus configuration. Accordingly, it can be restrained as much as possible that the formed image on the paper P is disarranged due to that the paper-transport belt 171 or the paper P supported thereon is contaminated by the leaked toner. Further, it is possible to restrain as much as possible a trouble from occurring in which the leaked toner intrudes into the developer cartridge 130 of other color located in the direction of the movement of the paper-transport belt 171 which is revolving (going around), and thereby the disarrangement of the formed image or a chain of the leak of the toner is occurred.

In the configuration of the present embodiment, the frictional heat generated at the felt member 136*b* is released through the blade body section 134*a* in the toner layer thickness control blade 134, which is provided so as to get on the side sealing member 136. Therefore, it is possible to effectively release the frictional heat generated at the felt member 136*b*, without complicating the configuration of the side sealing member 136.

In the configuration of the present embodiment, the side sealing member 136 is held down by the tip portion of the blade body section 134*a*. Accordingly, shear-deformation along the width direction of the side sealing member 136 is restrained. Therefore, it is possible to maintain a good close contact condition of the side sealing member 136 (felt member 136*b*) and the circumferential surface of the developing roller 132. That is, it is possible to maintain a sealing performance of the side sealing member 136 favorably.

In the configuration of the present embodiment, the blade side sealing member 137, which serves as the auxiliary sealing member, is provided so as to be interposed at the clearance between the blade body section 134*a* and the developing roller 132. Accordingly, the leak of the toner from the clearance can be restrained as much as possible.

Exemplification of Several Modified Embodiments:

As mentioned above, it should be noted that the embodiment described above is a mere example of a typical embodiment of the present invention which the applicant(s) of the present invention believe(s) is the best at the time of filing the application. Therefore, the present invention should not be limited to the above described embodiment. Accordingly, it is believed obvious that various modifications may be made with respect to the above described embodiment without departing from the spirit and the scope of the present invention.

Typical modified embodiments will now be described. In the explanation of the modified embodiments below, like reference characters with respect to members having the same configurations and functions as those described in the above-mentioned embodiment designate like or corresponding parts (members). The descriptions regarding these members in the above described embodiment may be incorporated hereinafter as long as they are not technically inconsistent.

Needless to say that modified embodiments of the present invention should not be limited to those described below. Further, a plurality of modifications may be combined as appropriate so long as there is no technical inconsistency.

It is also to be understood that the present invention (particularly, the elements or the configurations that are expressed operationally and/or functionally and that constitute or correspond to means for solving the problems of the present invention) should not be construed to be limited to the embodiments described above and the modifications described below on the basis of those descriptions. Such limited interpretation or limited construction unfairly damage the interests of the applicant (who hastens to file an application under first-to-file system) and unfairly benefits imitators, and thus should not be allowed, because it is against the purpose of a patent law which is to protect and utilize an invention.

(i) An image forming apparatus to which the present invention applies is not limited to a color laser printer. For example, the present invention may be preferably applied to an image forming apparatus of an electrophotography-type such as a color plain paper facsimile, a monochrome laser printer, a monochrome plain facsimile. Further, the present invention may be preferably applied to a toner (developer)-using type image forming apparatus other than the image forming apparatus of the electrophotography-type.

(ii) Referring to FIG. 1, the image-forming unit 101, which combines the developer cartridge 130 with the drum unit 140, may be removably supported by the body casing 110. Further, the body casing 110 may be configured in such a manner that the upper cover 111 is opened/closed in mounting/removing the developer cartridge 130 or the image-forming unit 101.

(iii) In place of the paper-transport belt 171 at the transfer section 170, a middle-transfer belt onto which a toner image is transferred from the photoconductor drum 142 may be used. In this case, the paper-feed cassette 120 and the paper-feed section 160 are configured in such a manner that the paper P is fed to a position opposite to the belt-drive roller 173.

Figure 6:
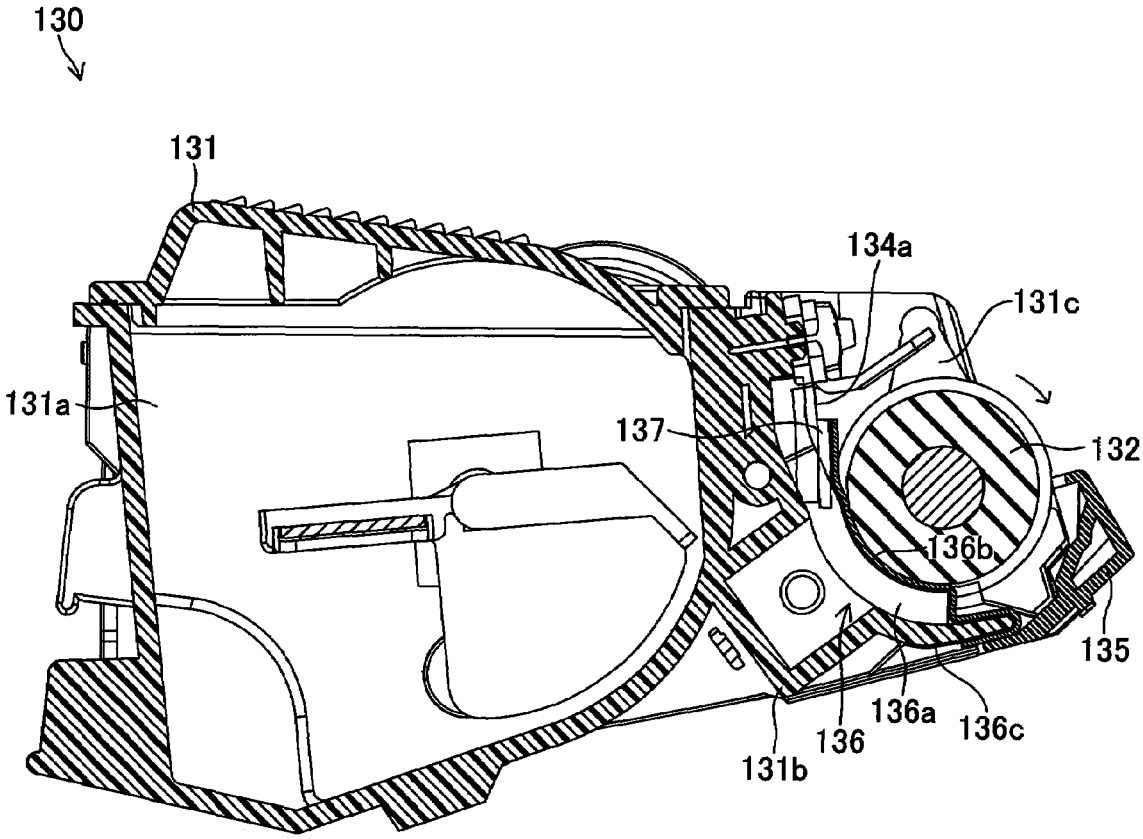
FIG. 6 is a cross-sectional view illustrating a configuration of a modified example of the developer cartridge shown in FIG. 4.
Figure 7:
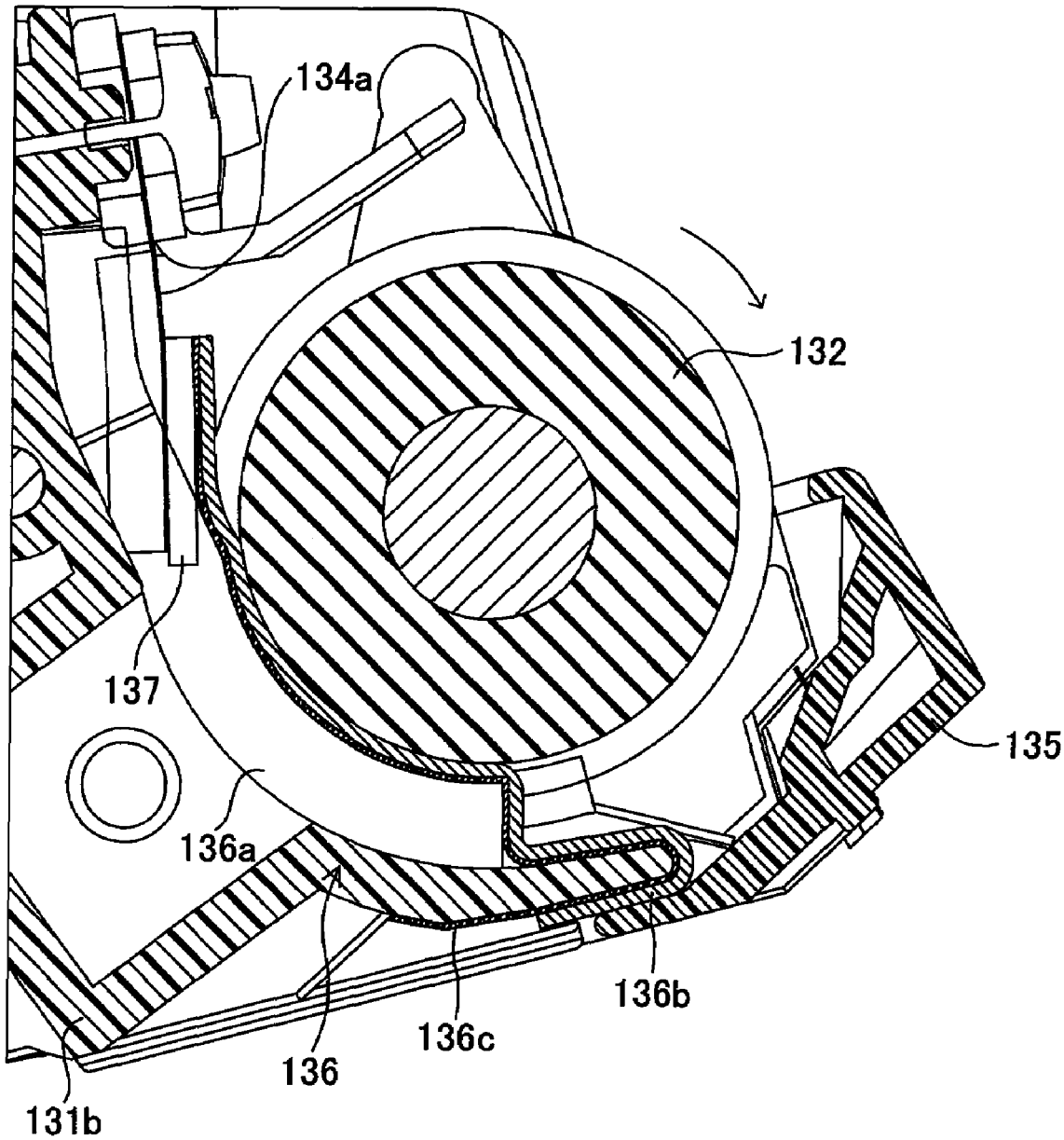
FIG. 7 is a cross-sectional enlarged view of a substantial portion of the modified developer cartridge shown in FIG. 6.

(iv) FIG. 6 is a cross-sectional view illustrating a configuration of a modified example of the developer cartridge 130 shown in FIG. 4. FIG. 7 is a cross-sectional enlarged view of a substantial portion of the modified developer cartridge 130 shown in FIG. 6.

Referring to FIGS. 6 and 7, the blade body section 134*a* in the present modified example is disposed at an inner side in the width direction with respect to the side sealing body 136*a* in the side sealing member 136. That is, in the present modified example, the tip portion of the blade body section 134*a* is not disposed at the position to press the side sealing body 136*a* from the upper side thereof. In other words, in the present modified example, the tip portion of the blade body section 134*a* does not contact with the felt member 136*b*.

The configuration of the present modified example includes a heat-releasing metallic sheet 136*c*. The heat-releasing metallic sheet 136*c* is composed of a thin plate made of copper having good heat conductance. The heat-releasing metallic sheet 136*c* is laminated to the felt member 136*b*. An end portion of the laminated body of the heat-releasing metallic sheet 136*c* and the felt member 136*b*, the end portion being at a downstream side (at upper sides in FIGS. 6 and 7) in the rotational direction of the developing roller 132, is attached and fixed to the blade side sealing member 137.

The other end portion of the laminated body of the heat-releasing metallic sheet 136*c* and the felt member 136*b*, which is at the upstream side in the rotational direction, extends outwardly from the end portion of the side sealing body 136*a* so as to turn around to reach the back side of the developer cartridge case 131. This end portion of the heat-releasing metallic sheet 136*c* is exposed to the outside.

That is, the heat-releasing metallic sheet 136*c* is formed to be longer than the felt member 136*b* so that the end portion of the heat-releasing metallic sheet 136*c* is capable of being exposed outwardly from the felt member 136*b*. The heat-releasing metallic sheet 136*c* is exposed to a space outside of the developer cartridge case 131 at the outside of the developing roller-exposure opening 131*c*.

In the configuration of the modified example described above, the frictional heat generated at the felt member 136*b* during the image-forming operation is transmitted to the heat-releasing metallic sheet 136*c*. The heat, which has been transmitted to the heat-releasing metallic sheet 136*c*, is released toward the space outside of the developer cartridge case 131 at a back side of the developer cartridge case 131 where the heat-releasing metallic sheet 136*c* is exposed. That is, by means of the space, the heat-releasing metallic sheet 136*c* is cooled.

Further, in the configuration of this modified example, a commercially available copper foil may preferably be used as the heat-releasing metallic sheet 136*c*. The heat-releasing metallic sheet 136*c* composed of the copper foil can be processed very easily. Moreover, the heat-releasing metallic sheet 136*c* can be laminated to the felt member 136*b* very easily by means of an attachment process using the two-sided tape, an adhesive agent or the like.

Furthermore, in the configuration of this modified example, releasing the heat from the felt member 136*b* through the heat-releasing metallic sheet 136*c* can be effectively and favorably performed, only by making the end portion of the heat-releasing metallic sheet 136*c* somewhat longer than the felt member 136*b* and exposing the end portion to the space outside of the developer cartridge case 131 at the back side of the developer cartridge case 131.

As described above, according to this modified example, the rise in temperature of the felt member 136*b* during the image-forming operation is effectively restrained by means of an extremely simplified apparatus configuration. Accordingly, the leak of the toner from the clearance between the felt member 136*b* and the circumferential surface of the developing roller 132 can effectively be restrained with the extremely simplified apparatus configuration.

(v) The heat-releasing metallic sheet 136*c* shown in FIG. 6 may be provided so as to be extended to reach and contact with the blade body section 134*a*. According to this configuration, not only the heat-releasing metallic sheet 136*c* but also the blade body section 134*a* functions as the heat-release member of the present invention. Accordingly, the sliding portion of the circumferential surface of the developing roller 132 and the felt member 136*b* is more effectively and favorably cooled.

(vi) Those operationally and functionally expressed elements corresponding to each of the elements which constitute the means of the present invention for solving the problems include the specific structures disclosed in the above embodiment and modified embodiments as well as any structures which can implement the operation and functions.

What is claimed is:

1. An image forming apparatus configured so as to arrange fine particles of a developer in an image-wise manner at an image-forming section to form an image by said developer onto a recording medium, said image forming apparatus comprising:

a body frame;

a developer-supply section accommodated within said body frame, said developer-supply section being configured to accommodate said developer and supplying said accommodated developer to said image forming section; and a recording-medium-transport mechanism configured so as to transport said recording medium along a predetermined transport path, while attaching said developer onto said recording medium, wherein said developer-supply section comprises:

a developer-carrying member formed to have a substantially cylindrical shape having a central axis in a direction perpendicular to a transport direction of said recording medium by means of said recording-medium-transport mechanism;

a developer-accommodation section configured to accommodate said developer-carrying member and said developer and to have an opening section which enables a part of a circumferential surface of said developer-carrying member to be exposed along said central axis;

a sealing member which is provided so as to be interposed between an end portion in said direction of said central axis of said developer-carrying member and said developer-accommodation section, and is configured so as to slide on said circumferential surface of said developer-carrying member to restrain a leak of said developer from said opening section to an outside of said developer-accommodation section;

a heat-release member having good heat conductance, said heat-release member being provided so as to extend toward an outside from a sliding portion of said circumferential surface of said developer-carrying member and said sealing member configured to release a frictional heat which is generated on said sealing member at said sliding portion;

wherein said developer-supply section further comprises a developer-carrying-amount control member which includes a control-member body section composed of a metallic plate as said heat-release member; and wherein said sealing member comprises:

a sliding member which is a sheet-like member having a surface of low coefficient of friction and is disposed so as to contact with said circumferential surface at said end portion of said developer-carrying member; and a sealing body which is attached to said sliding member and said developer-accommodation section and is composed of a foamable synthetic resin having an elasticity so as to be able to bias said sliding member toward said circumferential surface of said developer-carrying member, and wherein said developer-carrying-amount control member is disposed in such a manner that said control-member body section contacts by placement on said sliding member from above so as to elastically compress said sliding member.

2. An image forming apparatus according to claim 1, and a developer-carrying-amount control section provided at a tip portion of said control-member body section and configured to adjust a carrying amount of said developer on said circumferential surface of said developer-carrying member by contacting with said circumferential surface, and said developer-carrying-amount control member is fixed to said developer-accommodation section in such a manner that said sealing member contacts with said control-member body section.

3. An image forming apparatus according to claim 2, further comprising an auxiliary sealing member which is provided so as to be interposed between said control-member body section and said developer-carrying member.

4. An image forming apparatus according to claim 1, further comprising an auxiliary sealing member which is provided so as to be interposed between said control-member body section and said developer-carrying member.

5. A developer cartridge configured so as to accommodate a developer and to supply said developer to an image-forming section at which fine particles of said developer is to be arranged in an image-wise manner in a body frame of an image forming apparatus, said developer cartridge being removably attached to said body frame, comprising, a developer-carrying member formed to have a substantially cylindrical shape;

a developer-accommodation section configured to accommodate said developer-carrying member and said developer and to have an opening section which enables a part of a circumferential surface of said developer-carrying member to be exposed along a central axis of said substantially cylindrical shape;

a sealing member which is provided so as to be interposed between an end portion in a direction of said central axis of said developer-carrying member and said developer-accommodation section, and is configured so as to slide on said circumferential surface of said developer-carrying member configured to restrain a leak of said developer from said opening section to an outside of said developer-accommodation section;

a heat-release member which has good heat conductance and is provided so as to extend toward an outside from a sliding portion of said circumferential surface of said developer-carrying member and said sealing member configured to release a frictional heat generated on said sealing member at said sliding portion;

further comprising a developer-carrying-amount control member which includes a control-member body section composed of a metallic plate as said heat-release member;

wherein said sealing member comprises:

a sliding member which is a sheet-like member having a surface of low coefficient of friction and is disposed so as to contact with said circumferential surface at said end portion of said developer-carrying member; and a sealing body which is attached to said sliding member and said developer-accommodation section and is composed of a foamable synthetic resin having an elasticity so as to be able to bias said sliding member toward said circumferential surface of said developer-carrying member, and wherein said developer-carrying-amount control member is disposed in such a manner that said control-member body section contacts by placement on said sliding member from above so as to elastically compress said sliding member.

6. A developer cartridge according to claim 5, further comprising a developer-carrying-amount control section provided at a tip portion of said control-member body section and configured to adjust a carrying amount of said developer on said circumferential surface of said developer-carrying member by contacting with said circumferential surface, and wherein said developer-carrying-amount control member is fixed to said developer-accommodation section in such a manner that said sealing member contacts with said control-member body section.

7. A developer cartridge according to claim 6, further comprising an auxiliary sealing member which is provided so as to be interposed between said control-member body section and said developer-carrying member.

8. A developer cartridge according to claim 5, further comprising an auxiliary sealing member which is provided so as to be interposed between said control-member body section and said developer-carrying member.

* * * * *